United States Patent [19]

Klomp

[11] 4,200,192

[45] Apr. 29, 1980

[54] CARTON CONTAINING AN ARTICLE PACKAGED THEREIN

[75] Inventor: Franciscus M. Klomp, Eindhoven, Netherlands

[73] Assignee: U.S. Philips Corporation, New York, N.Y.

[21] Appl. No.: 884,975

[22] Filed: Mar. 9, 1978

[30] Foreign Application Priority Data

May 11, 1977 [NL] Netherlands ..... 7705187

[51] Int. Cl.[2] ..... B65D 85/42

[52] U.S. Cl. ..... 206/418; 206/45.14; 229/39 B

[58] Field of Search ..... 229/39 B; 206/418, 419, 206/420, 45.14

[56] References Cited

U.S. PATENT DOCUMENTS

| | | | |
|---|---|---|---|
| 1,506,587 | 8/1924 | Hunt | 229/39 B |
| 3,123,204 | 3/1964 | Baker et al. | 206/45.19 |
| 3,181,694 | 5/1965 | Candell | 206/45.14 |

FOREIGN PATENT DOCUMENTS

| | | | |
|---|---|---|---|
| 1150466 | 8/1957 | France | 229/39 B |
| 84992 | 9/1949 | Norway | 229/39 B |
| 356714 | 10/1961 | Switzerland | 229/39 B |
| 706393 | 3/1954 | United Kingdom | 229/39 B |
| 1280819 | 7/1972 | United Kingdom | 229/39 B |
| 1335729 | 10/1973 | United Kingdom | 206/45.14 |

*Primary Examiner*—Herbert F. Ross

*Attorney, Agent, or Firm*—Thomas A. Briody; William J. Streeter; Rolf E. Schneider

[57] ABSTRACT

A carton of rectangular cross section in which an article is packaged, the carton has four side walls folded along parallel first score lines and is closed at one end by four flaps formed by second score lines extending transversely to the first score lines, the four flaps being connected together along score lines extending in elongation of the first score lines. Two oppositely located flaps from the points of intersection of the first score lines with the second score lines have respective obliquely extending third score lines, at least one of such oppositely located flaps being positioned between the article and a side wall of the carton so that the carton is locked against opening at such one end.

3 Claims, 8 Drawing Figures

CARTON CONTAINING AN ARTICLE PACKAGED THEREIN

Figure 1:
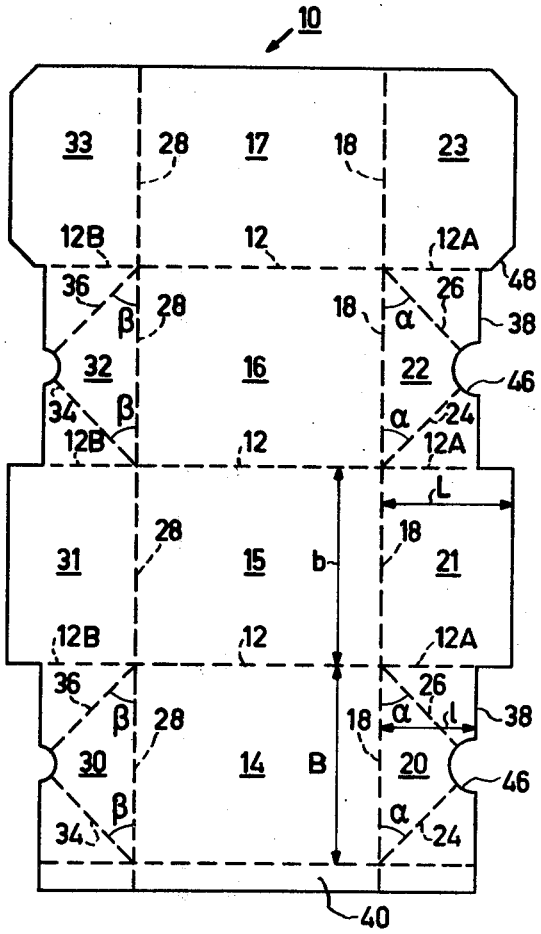

This invention relates to a carton of rectangular cross-section in which an article is packaged, which carton has four side walls folded along parallel first score lines and which is closed at one end by four flaps which are each formed by a second score line, which crosses the first score lines, the flaps being connected together along score lines which respectively extend from the first score lines, two of such flaps being oppositely located and each having oblique third score lines respectively extending from the points of intersection of the first score lines with the second score line, the two other flaps overlapping each other.

U.S. Pat. No. 3.181.694 discloses such a carton in which a reflector lamp is packaged, said carton having at its lower end a closure as described above. All four flaps of the closure lie in one plane. A disadvantage of this carton is that the closure is able to be opened readily under the influence of only a slight internal pressure, unless some auxiliary securing means, such as an adhesive, rivets or the like is used. Therefore the lamp has to be arranged diagonally in the carton, the lamp base being supported on a lower end near a side wall of the carton so that the opening moment exerted on the closure by the lamp is only small. If the lamp is arranged diagonally in the carton with its base uppermost, the carton may still tend to open because the opening moment exerted on the closure in this arrangement can be greater. The upper end of the known carton is provided with specially shaped inwardly bent flaps supporting and enclosing the lamp in the desired position in the carton. In this position the flaps are secured by the presence of the lamp so that the carton does not tend to open when it is inverted. This construction requires that the upper end of the carton is generally uncovered, so that the lamp is readily accessible from the outside and consequently the lamp can easily be damaged.

It is the object of the present invention to provide a carton having an article packaged therein, in which the presence of the article secures the closure of the carton at one end without the construction of said closure necessarily requiring that the article is readily accessible from outside.

According to the invention, there is provided a carton of rectangular cross-section in which an article is packaged, which carton has four side walls which are folded along parallel first score lines and which is closed at one end by four flaps which are each formed by a second score line which crosses the first score lines, the flaps being connected together along score lines which respectively extend from the first score lines, two of such flaps being oppositely located and each having oblique third score lines respectively extending from the points of intersection of the first score lines with the second score line, the two other flaps overlapping each other, characterized in that at least one of the flaps with third score lines is positioned between the article and the side wall of the carton which has a second score line common with said flap.

Before packaging the article in the carton, the latter is first closed at one end. The step of making the closure is effected by pressing together the flaps initially extending in the elongation of side walls, the flaps having third score lines being also folded along the third score lines.

In the closed condition of the first end the flaps folded along the third score lines are situated within the carton and the remaining flaps are situated along the end face and partly overlap each other. At least one of the flaps situated within the carton is then folded along its second score line as a hinge so that this flap lies against the adjacent side wall. In this position of the flaps the article is placed in the carton through the second end, the flap lying against the side wall being trapped between the article and the side wall. The carton is now locked against opening at the first end. In fact, when the carton is opened, all the flaps should open outwardly, which is impossible as long as one flap is enclosed. When the packaged article is heavy, it is alternatively possible to trap both flaps having third score lines between the article and the respective side walls of the carton, so that an extra rigid closure can be obtained.

Articles having a variety of different shapes can be packaged in the carton, for example, electric lamps, such as reflector lamps, electric apparatus, such as coffee grinders and clocks, and glassware, such as bottles. Of course, the internal dimensions of the carton should be suitable for the article to be enclosed, so that at least one internal flap of the carton can be trapped between the article and its corresponding side wall of the carton.

As a constructional material for the carton blank, solid fibre board, for example, duplex board or strawboard has been found to be suitable. Corrugated board, for example, mini-corrugated board may also be used.

The carton may be constructed so as to be entirely closed so that the packaged article is not readily accessible or even visible from the outside. If, however, it should be desirable for the article to be visible, an opening may be provided in a carton side wall or in an end closure. The size and the shape of the opening may correspond to those features of the part of the article which it is desired to display.

In one embodiment, the third score lines enclose an angle of at least 42° and at most 44° with the second score line.

In this embodiment, the flaps having third score lines are placed under tension upon closing the carton so that the flaps in the closed position extend obliquely within the carton. An advantage of this construction is that a slight pressure exerted on either side of the flap on the outside of the carton is sufficient to cause the flap to lie against the adjoining side wall. When a carton according to this embodiment is used, no extra tool is required in order to fold the flap against the side wall when the article is to be placed in the carton.

If only one flap is to be trapped between the article and the corresponding side wall of the carton, one of the flaps having third score lines may serve to support the article in a resilient manner.

The carton in which an article is packaged according to the invention may be closed at the second end by known means. For example, the second end may have a flap which is hingedly connected to a side wall and is secured to the oppositely located side wall. Alternatively, the carton may be closed at the second end by two flaps which overlap each other and which are connected together by means of an adhesive or riveting. A further embodiment is preferred where the packaged article is expected to engage mainly places of the closure at the second end situated near the side walls. In this further embodiment, the second end of the carton is closed by a closure similar to that which closes the first end of the carton. For the closure at the second end, however, the third score lines enclose an angle of at least 42° and at most 45° with the second score line. The angle between such respective score lines is preferably between 42° and 44° so that the flaps having third score lines experience such a stress upon closing that the flaps in the closed condition extend obliquely within the carton. With such a carton, initially an increasing resistance and afterwards a decreasing resistance are experienced upon effecting the closing operation. The same phenomenon occurs upon opening the carton, the resistance initially increasing and then decreasing accordingly as the carton is further opened. As a result of this a larger pressure on the inside of the closure is necessary to open the carton than when the oblique score lines extend at an angle of 45° with the second score line.

The invention also relates to a carton of rectangular cross-section or a blank for forming a carton of rectangular cross-section for packaging an article, which carton has four side walls folded along parallel first score lines and at one end has four flaps which are formed by a second score line which crosses the first score lines, the flaps being connected together along score lines which respectively extend from the first score lines, two non-adjoining flaps from the points of intersection of the first score lines with the second score line each having obliquely extending third score lines, the two other flaps overlapping each other, in which the third score lines enclose an angle of at least 42° and at most 44° with the second score line of the flaps situated opposite to each other.

In one embodiment of the carton, the second end of the carton is provided with flaps in the same manner, the respective obliquely extending score lines in the two oppositely located flaps enclosing an angle of at least 42° and at most 45° with the second score line.

Figure 2:
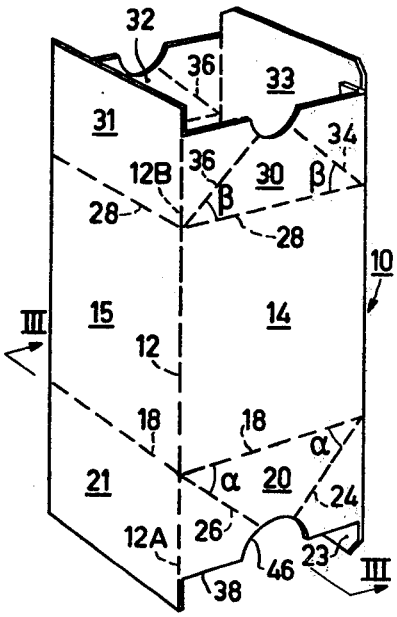
Figure 3A:
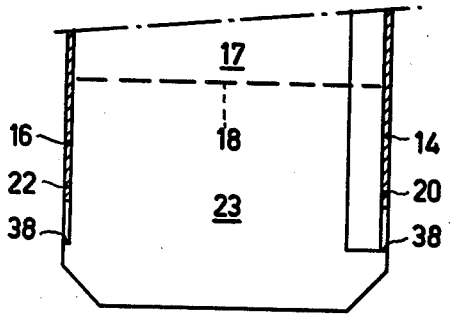
Figure 3D:
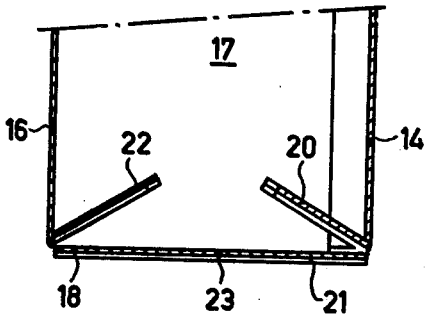
Figure 3B:
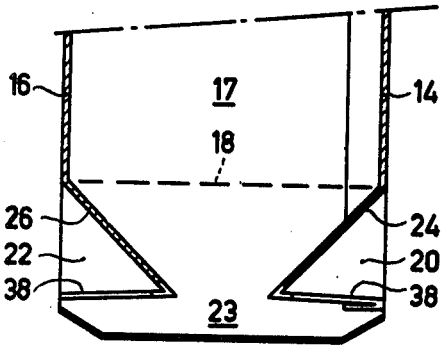
Figure 3E:
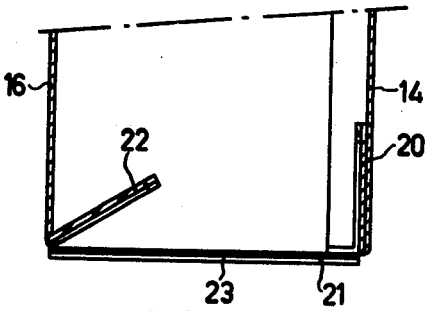
Figure 3C:
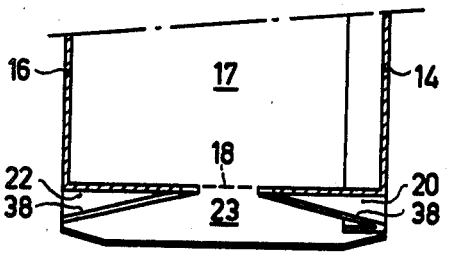
Figure 4:
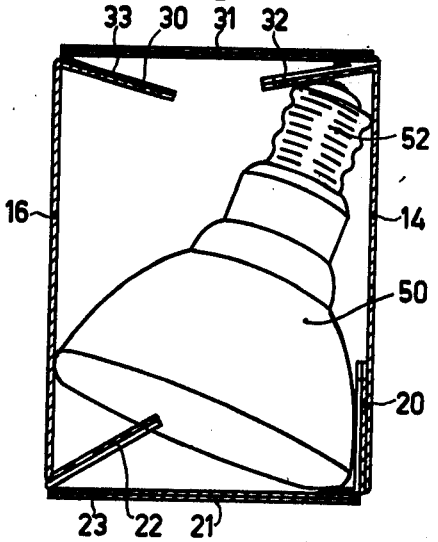

By way of example, a particular embodiment of the invention will now be described in greater detail with reference to the accompanying drawings, in which:

FIG. 1 is a plan view of a blank for manufacturing a carton of a rectangular cross-section, FIG. 2 is a perspective view of the carton manufactured from the blank of FIG. 1 before an article is packaged therein, FIGS. 3*a*, 3*b*, 3*c*, 3*d* and 3*e* are partial sectional views taken on the line III—III of FIG. 2 and showing various positions of the flaps at the first end of the carton, and FIG. 4 is a longitudinal sectional view taken on the line III—III of the carton shown in FIG. 2 in which a reflector lamp is packaged.

FIG. 1 shows a carton blank 10 which is formed from duplex cardboard and which is divided into four side walls 14, 15, 16 and 17 by parallel first score lines 12. The side walls are connected to flaps 20, 21, 22 and 23 at the first end of the carton 10 by a second score line 18. The flaps 20, 21, 22 and 23 are hingedly connected together along further score lines 12A which respectively extend from the score lines 12. A pair of non-adjoining flaps 20 and 22 which in the formed carton are intended to be situated opposite each other each have two oblique third score lines 24 and 26. The third score lines 24 and 26 extend from an inner corner of the flaps 20 and 22 to an outer edge 38 of the same and each encloses an angle $\alpha$ or 43° with the second score line 18. The second end of the carton 10 has flaps 30, 31, 32 and 33 which are formed by a fourth score line 28 crossing the first score lines 12. The flaps 30, 31, 32 and 33 are hingedly connected together along further score lines 12B which respectively extend from the score lines 12. The non-adjoining flaps 30 and 32 have oblique fifth score lines 34 and 36 which each enclose an angle $\beta$ of 44° with the fourth score line 28. A glue flap 40 is hingedly connected to the free side edge of the side wall 14 and to the adjacent flaps 20 and 30. The glue flap 40 can be adhesively secured to the free side edge of the side wall 17 and to the adjoining flaps 23 and 33 so as to form a carton having a rectangular cross-sectional shape.

In assembly of a carton from the above-described blank, the glue flap 40 is coated with an adhesive, after which the side walls and the flaps connected thereto are folded with respect to each other along the first score lines 12, 12A and 12B, so that the carton has the shape shown in FIG. 2.

Before packaging an article in the carton, the latter is first closed at the first end. This is done by pushing towards each other the flaps 20, 21, 22 and 23 which initially constitute elongations of the respective side walls 14, 15, 16 and 17, the flaps each folding along the second score line 18 and the flaps 20 and 22 being also folded along the third score lines 24 and 26. The flaps 20 and 22 each have a semicircular recess 46 which facilitates the operation of making the folds along the third score lines 24 and 26 near the outer edge 38. The length l of the flaps 20 and 22 is less than half the width b of the adjoining side walls 15 and 17, so that when the carton is closed the flaps 20 and 22 do not touch each other. The length L of the flaps 21 and 23 on the contrary is greater than half the width B of the adjoining side walls 14 and 16, so that said flaps partly overlap each other when the carton is closed, the flap 23 which has beveled corners 48 sliding below the flap 21.

The operation of closing the carton at the first end will be explained in detail with reference to FIGS. 3*a*, 3*b*, 3*c*, 3*d* and 3*e*. For this purpose, the Figures show a number of positions which the flaps 20, 21, and 22 and 23 assume upon closing the end of the carton 10. In FIG. 3*a* the carton is still open, the flaps extending as elongations of the respective side walls. FIGS. 3*b* and 3*c* depict two intermediate positions of the closing operation in which the flaps 20 and 22 are shown folded along the third score lines 24 and 26 which make an angle $\alpha$ of 43° with the second score line 18, past the end face through the second score line 18 before the flaps 21 and 23 reach the end face. In FIG. 3*d* the carton is closed at the first end, the flaps 21 and 23 partly overlapping each other and the flaps 20 and 22 projecting obliquely within the carton. Before placing an article in the carton, the flap 20 is folded against the inner side of the side wall 14 by a slight pressure on the outside of the side walls 15 and 17 on either side of the flap 20, as is shown in FIG. 3*e*. In this position of the flaps 20, 21, 22 and 23 the article is placed in the carton, the flap 20 being then held between the article and the side wall 14.

FIG. 4 shows a reflector lamp 50 packaged in the carton of FIG. 2. The reflector lamp 50 is arranged diagonally in the carton, the lamp base 52 being uppermost. The lamp bears on the bottom of the first end formed by the flaps 20, 21, 22 and 23, the flap 20 being held between the reflector lamp 50 and the side wall 14 of the carton. The lamp is furthermore resiliently supported by the flap 22. The second end of the carton is closed by the flaps 30, 31, 32 and 33. Closing is carried out after the reflector lamp 50 has been placed in the carton. The flaps 30, 31, 32 and 33 are for that purpose pushed towards each other, closure being effected in a manner similar to that shown in FIGS. 3*a* to 3*d*. In the closed position the flaps 31 and 33 overlap each other and the flaps 32 and 34 project obliquely within the carton. Since the angle $\beta$ for the flaps 30 and 32 is smaller than the angle $\alpha$ for the flaps 20 and 22, the flaps 30 and 32 extend less deeply within the formed carton.

Although the Figures show a carton of which the flaps of the second end overlapping each other are connected to the same side walls to which the flaps of the first end overlapping each other are respectively connected, the overlapping flaps of the second end may alternatively be connected to the two other side walls of the carton.

What is claimed is:

1. A package comprising a rectangular cross-section carton having four side walls folded along parallel first score lines; a first closure at one end of the carton composed of four flaps, each of said four flaps having been formed by a second score line crossing the first score lines and parallel respective first score line extensions of said first score lines, all four of said flaps having been respectively folded inwardly along their respective second score lines, two of said four flaps being oppositely located and each of such two oppositely disposed flaps having oblique third score lines respectively extending from the points of intersection of the first score lines with the second score line, said two oppositely disposed flaps being folded into the carton with at least one of said two oppositely disposed flaps lying in contact with its respective side wall; an article enclosed within the carton and trapping said one oppositely disposed flap between the article and said side wall, the other two of said four flaps being free of score lines and overlapping each other, said trapping of such one oppositely disposed flap rendering said enclosed article inaccessible directly from the outside through said first closure; and a second closure for the other end of the carton, said second closure being so formed as also to render the enclosed article inaccessible therethrough directly from the outside.

2. A package according to claim 1, in which the third score lines enclose an angle of at least 42° and at most 44° with the second score line.

3. A package according to claim 1, in which the second closure is composed of four flaps, each of such latter four flaps having been formed by a fourth score line extending transversely across the first score lines and parallel respective second score line extensions of said first score lines, all four of said latter flaps having been folded inwardly along their respective fourth score lines, two of said latter four flaps being oppositely located and each of such latter two oppositely disposed flaps having oblique fifth score lines respectively extending from the points of intersection of the first score lines with the fourth score line and respectively enclosing an angle of at least 42° and at most 45° with the fourth score line, the other two of said latter four flaps being free of score lines and overlapping each other, such arrangement of said latter four flaps rendering said enclosed article also inaccessible directly from the outside through said second closure.

* * * * *